US011408581B2

(12) United States Patent
Prime et al.

(10) Patent No.: US 11,408,581 B2
(45) Date of Patent: Aug. 9, 2022

(54) LIGHTING MODULE WITH STYLING MASK

(71) Applicant: Valeo Vision, Bobigny (FR)

(72) Inventors: Sylvain Prime, Bobigny (FR); Maxime Laminette, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 17/414,013

(22) PCT Filed: Dec. 17, 2019

(86) PCT No.: PCT/EP2019/085783

§ 371 (c)(1),
(2) Date: Jun. 15, 2021

(87) PCT Pub. No.: WO2020/127371

PCT Pub. Date: Jun. 25, 2020

(65) Prior Publication Data

US 2022/0057067 A1 Feb. 24, 2022

(30) Foreign Application Priority Data

Dec. 18, 2018 (FR) ..... 1873210

(51) Int. Cl.

| | |
|---|---|
| ***F21S 43/50*** | (2018.01) |
| ***F21S 43/241*** | (2018.01) |
| ***F21W 104/00*** | (2018.01) |

(52) U.S. Cl.

CPC ..... *F21S 43/50* (2018.01); *F21S 43/241* (2018.01); *F21W 2104/00* (2018.01)

(58) Field of Classification Search

CPC ..... F21S 43/50; F21S 43/241; F21W 2104/00
See application file for complete search history.

(56) References Cited

U.S. PATENT DOCUMENTS

| | | | |
|---|---|---|---|
| 2003/0016930 | A1 | 1/2003 | Inditsky |
| 2014/0177278 | A1 | 6/2014 | Sakamoto et al. |
| 2018/0031204 | A1 | 2/2018 | De Lamberterie et al. |

FOREIGN PATENT DOCUMENTS

| | | | |
|---|---|---|---|
| DE | 10032927 | A1 | 1/2002 |
| DE | 102004054732 | A1 | 5/2006 |

(Continued)

OTHER PUBLICATIONS

European Patent Office, International Search Report (including English translation) and Written Opinion of International Application No. PCT/EP2019/085783, dated Apr. 8, 2020.

*Primary Examiner* — Anabel Ton
(74) *Attorney, Agent, or Firm* — Valeo Vision

(57) ABSTRACT

The invention relates to an optical guide made from transparent or translucent material extending along a main direction and including a rounded, tubular guide portion formed with a rounded, tubular dioptric interface, the tubular guide portion being suitable for guiding light along the main direction through successive reflections off the dioptric interface with a rib adjacent to the guide portion that is suitable for allowing light to exit the tubular guide portion. The rib exhibits a variable shape along the main direction so as to modify the amount of light that exits along the main direction. The invention also relates to a lighting module that includes the optical guide and a lighting device that includes the lighting module.

15 Claims, 5 Drawing Sheets

(56) References Cited

FOREIGN PATENT DOCUMENTS

| | | | | | |
|---|---|---|---|---|---|
| EP | 2530503 | A1 | | 12/2012 | |
| EP | 2541291 | B1 | * | 4/2021 | ..... G02B 6/0053 |
| JP | 2014007014 | A | | 1/2014 | |
| JP | 2016207351 | A | | 12/2016 | |
| WO | 2016124770 | A1 | | 8/2016 | |

* cited by examiner

LIGHTING MODULE WITH STYLING MASK

CROSS-REFERENCE TO RELATED APPLICATIONS

This is a 371 application (submitted under 35 U.S.C. § 371) of International Application No. PCT/EP2019/085783 (WO2020127371) filed on 17 Dec. 2019, which claims the priority date benefit of French Application No. FR1873210 filed on 18 Dec. 2018, the disclosures of which are hereby incorporated by reference in their entirety.

TECHNICAL FIELD

The invention relates to the field of luminous signaling and of lighting, in particular for motor vehicles.

BACKGROUND

In the field of motor-vehicle lighting and signaling, optical guides are being used increasingly frequently. Specifically, these have the advantage of being able to have very varied geometric shapes and of allowing an illuminated area to be provided in regions of a lighting and/or signaling device that are not easily accessible. This is particularly advantageous in the current context of motor-vehicle manufacturers seeking to give their vehicles a signature that is specific thereto, especially by offering lighting and/or signaling devices of complex shapes.

Patent document US 2014/0177278 A1 discloses a plate-shaped light guide with two opposite main faces. Light produced by light sources enters into the guide via one of the side faces. The light rays then propagate via successive reflections from the two main faces of the guide. Specifically, said faces form dioptric interfaces with the ambient air and thus allow rays incident at an angle larger than the limiting angle of refraction to undergo so-called total reflection. One of the main faces of the guide comprises microstructures taking the form of hollows or bumps, themselves also forming dioptric interfaces with the ambient air. Rays propagating essentially through the extent of the guide that meet a face of the hollows undergo a total reflection that is directed toward the other main face. The latter is then the face through which the guide is exited.

It is also known to associate, in an optical guide, a generally tubular guiding segment with a web adjacent to said segment. The guiding segment and the web are then connected to each other by a rib that is thick enough to transmit a maximum of light to the web.

However, in certain configurations with potentially complex and extensive shapes, the light exiting from the web may exhibit defects as regards uniformity.

The objective of the invention is to mitigate at least one of the drawbacks of the aforementioned prior art. More particularly, the objective of the invention is to allow the uniform production of light, in particular in the context of luminous signaling with potentially complex shapes.

SUMMARY

The subject of the invention is an optical guide made of transparent or translucent material, extending in a main direction, and comprising a tubular and rounded guiding segment that forms, with the exterior environment, a tubular and rounded dioptric interface, said segment being able to guide light along the main direction via successive reflections from the dioptric interface; and a rib adjacent to the guiding segment, able to make light exit from said segment; noteworthy in that the rib has a variable shape along the main direction so as to modulate the amount of light exiting along said direction.

By optical guide, what is meant in the present application is a transparent or translucent part inside of which light rays controllably propagate from one of the ends of the guide, called the entrance face, to at least one exit face. The light is generally controllably propagated via successive total reflections from various reflection faces internal to the optical guide.

According to one advantageous embodiment of the invention, the variable shape of the rib comprises the thickness of the rib and/or an inclination of the rib with respect to a direction transverse to the main direction, passing through the center of the guiding segment and the rib where it is adjacent to said segment.

According to one advantageous embodiment of the invention, over the entire extent of the rib, the thickness of said rib varies by a value higher than 50% of the average value of said thickness, and/or the inclination of the rib varies by more than 20°.

According to one advantageous embodiment of the invention, the guide comprises at one end an entrance face for light, the shape of the rib being variable so as to promote the exit of light as distance from said face increases, and thus to compensate for a decrease in the amount of light travelling the guiding segment.

According to one advantageous embodiment of the invention, the thickness of the rib increases with distance from the entrance face and/or the inclination of the rib decreases with distance from the entrance face.

According to one advantageous embodiment of the invention, the guiding segment has an average diameter, the rib having a maximum thickness smaller than 70% of said diameter. Preferably, the maximum thickness of the rib is smaller than 60% of the average diameter of the guiding segment.

According to one advantageous embodiment of the invention, the average diameter of the guiding segment is constant over more than 90% of the length of said segment.

According to one advantageous embodiment of the invention, the guiding segment has an average diameter and the optical guide extends in the main direction over a length longer than 20 times said diameter.

According to one advantageous embodiment of the invention, the variable shape of the rib exhibits variations over more than 80% of the length of the guide.

According to one advantageous embodiment of the invention, the guide further comprises a web adjacent to the rib and optically connected to the guiding segment by said web. Advantageously, the web is unitary and integrally formed with and made of the same material as the rib and the guiding segment.

According to one advantageous embodiment of the invention, the guiding segment is a first guiding segment and the rib is a first rib, the optical guide comprising a second guiding segment and a second rib adjacent to the web.

According to one advantageous embodiment of the invention, the web comprises two main and opposite faces, at least one of said faces comprises regions with a means of allowing light to exit through one of said faces, forming lighting regions.

According to one advantageous embodiment of the invention, the means of allowing light to exit on one of the main faces of the web comprise a grain.

According to one advantageous embodiment of the invention, the grain has an average grain size larger than 20 μm and/or smaller than 40 μm.

Another subject of the invention is a luminous module comprising: at least one light source; at least one optical guide able to be supplied with light by the at least one light source; noteworthy in that the at least one optical guide is according to the invention.

According to one advantageous embodiment of the invention, the at least one optical guide further comprises a web adjacent to the rib and optically connected to the guiding segment by said web, the web comprising two main and opposite faces, at least one of said faces comprising regions with a means of allowing light to exit through one of said faces, by way of lighting regions, and the module further comprises a mask placed against the web, said mask comprising windows aligned with the regions provided with the means of allowing light to exit.

According to one advantageous embodiment of the invention, the mask is made of transparent or translucent material and comprises a paint delineating the windows.

According to one advantageous embodiment of the invention, the windows of the mask have grained faces facing the web.

Another subject of the invention is a luminous motor-vehicle device comprising at least one luminous, luminous-signaling module; noteworthy in that the at least one luminous module is according to the invention.

Advantageously, the luminous device is a headlamp and further comprises at least one luminous lighting module.

According to one advantageous embodiment of the invention, the at least one optical guide further comprises a web adjacent to the rib and optically connected to the guiding segment by said web, the web comprising two main and opposite faces, at least one of said faces comprising regions with a means of allowing light to exit through one of said faces, by way of lighting regions, the one or more guiding segments extending predominantly transversely and the web extending from said one or more guiding segments predominantly longitudinally forward, the lighting regions of the web being located on an upper main face of said web.

Another subject of the invention is a luminous module comprising: at least one light source; at least one optical guide with a tubular and rounded guiding segment that forms, with the exterior environment, a tubular and rounded dioptric interface, said segment being able to guide light along the main direction via successive reflections from the dioptric interface, and a web optically connected to said segment and able to be supplied with light by said segment and to form lighting regions; and a mask placed against the web, said mask comprising windows aligned with the lighting regions.

According to one advantageous embodiment, the mask is made of transparent or translucent material and comprises a paint delineating the windows.

According to one advantageous embodiment, the windows of the mask have grained faces facing the web.

According to one advantageous embodiment, the lighting regions extend beyond the corresponding windows so as to avoid parallax defects.

According to one advantageous embodiment, the web comprises two main and opposite faces, at least one of said faces comprises regions with a means of allowing light to exit through one of said faces, forming the lighting regions.

According to one advantageous embodiment, the means of allowing light to exit on one of the main faces of the web comprise a grain.

According to one advantageous embodiment, the grain has an average grain size larger than 20 μm and/or smaller than 40 μm.

The measures of the invention are advantageous in that they allow a luminous signaling function of potentially complex shape to be provided while ensuring the uniformity of the light from various points of observation in front of the luminous module remains good.

Varying the shape of the rib along the guiding segment allows the amount of light emitted to be modulated depending on the requirements with respect to the light. In other words, this modulation not only allows the gradual decrease in light along the guiding segment to be compensated for but also the amount of light distributed to be dosed depending on the requirements. Specifically, for reasons of uniformity especially, it is possible for the amount of light required along the guiding segment not to remain constant. The modulation achieved via the shape of the rib thus confers great freedom, especially as regards complex shapes and configurations. In addition, varying the shape of the rib as regards its thickness and as regards its inclination also allows profiles to be formed on the two opposite faces of the optical guide, level with the rib, which profiles are particularly favorable to the production of said guide by injection molding of plastic, in particular as regards demolding. Demolding is particularly tricky with large and thin parts, i.e. parts that typically extend more than 150 mm and that have an average thickness smaller than 7 mm, this being precisely the case in the exemplary embodiment below.

The grain of the exit face of the web is an advantageous way of making the light exit and may be produced during molding.

The use of a mask made of transparent or translucent material covered with an opacifying (make opaque) coating in such a way as to leave windows is also advantageous because it makes it possible to obtain a very satisfactory optical result, with very good luminous uniformity along the windows and avoidance of parallax defects.

DETAILED DESCRIPTION

Figure 1:
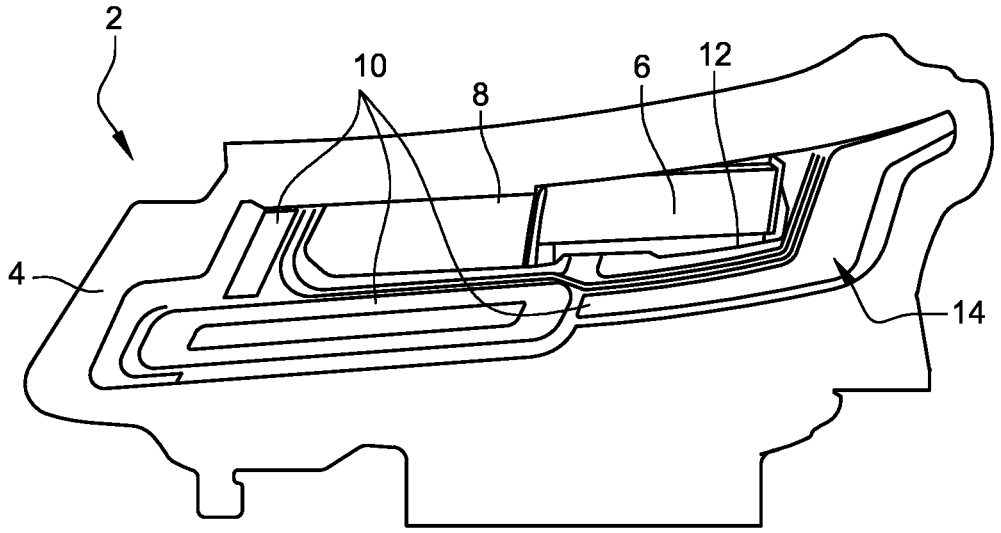
FIG. 1 is a perspective, face-on representation of a headlamp according to the invention, comprising a luminous module also according to the invention.

FIG. 1 illustrates a motor-vehicle headlamp 2, in the present case a left headlamp, it being understood that the right headlamp is symmetrical to the left headlamp with respect to a longitudinal and vertical plane of symmetry.

The headlamp 2 comprises a housing 4 forming a cavity that opens forward, the latter being closed by an outer lens (not shown). The cavity encloses two lighting modules 6 and 8 for performing low-beam and high-beam functions. It also encloses a luminous DRL module 10 (DRL being the acronym of daytime running light). The cavity of the headlamp 2 further comprises a luminous signaling module 12 located in the present case between the luminous DRL module 10 and the low-beam and high-beam modules 6 and 8. It is a question of a style luminous module intended to be permanently on. As may be seen in FIG. 1, it comprises three luminous strips extending essentially transversely and arranged side-by-side in a longitudinal direction, so as to be able to be seen and identified by an observer located in front of the vehicle, in a sector of ±45° with respect to the longitudinal axis of the vehicle, at, in a vertical plane, an angle of +20° with respect to the horizontal. To this end the headlamp 2 comprises a mask 14 with openings for the DRL module 10 and comprising transparent windows corresponding to the luminous strips of the style signaling module 12.

Figure 2:
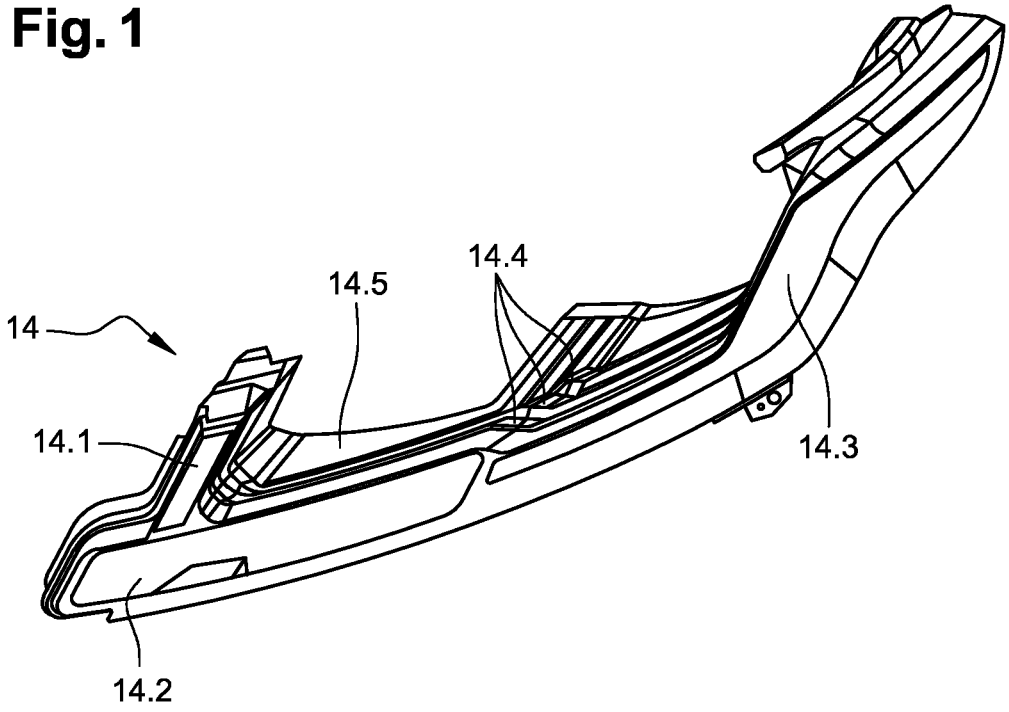
FIG. 2 is a perspective face-on representation of the mask of the headlamp of FIG. 1.

FIG. 2 illustrates in perspective the mask 14 of the headlamp of FIG. 1. The mask 14 includes openings 14.1, 14.2 and 14.3 for the DRL module 10 (FIG. 1). It also comprises elongated windows, in the present case three transparent windows 14.4 intended to form the luminous strips of the style signaling module 12. The mask 14 is advantageously made of transparent or translucent material covered, on the exterior face, with a layer of opacifying paint 14.5 (for making opaqueness), with the exception of the windows 14.4. More particularly, the mask 14 is advantageously a part of unitary construction produced by injection molding of plastic.

Figure 3:
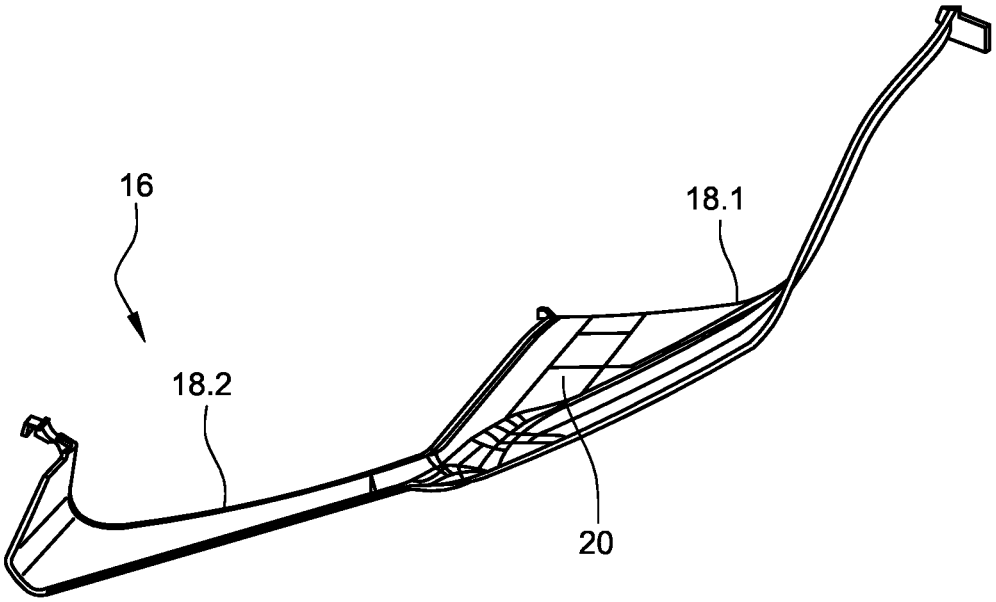
FIG. 3 is a perspective face-on representation of the optical guide placed behind and under the mask of FIG. 2 in the headlamp of FIG. 1.
Figure 4:
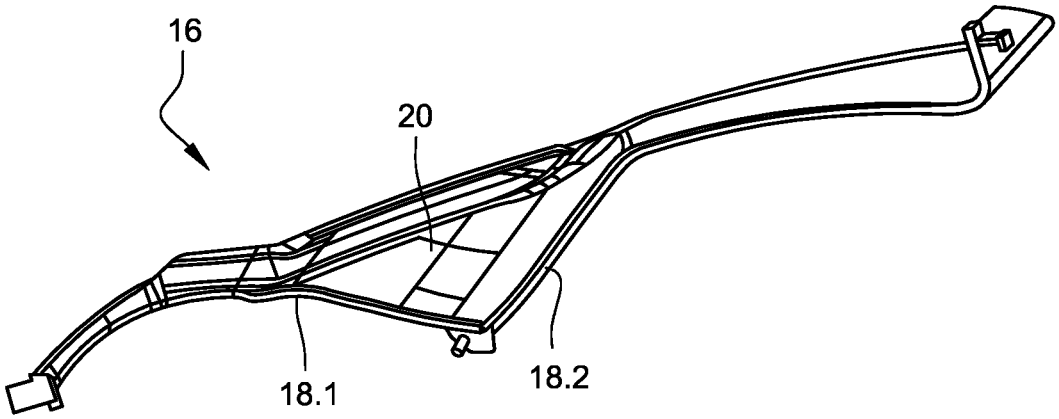
FIG. 4 is a rear perspective representation of the optical guide of FIG. 3.

FIGS. 3 and 4 are two perspective views of an optical guide 16 of the style signaling module 12 (FIG. 1) placed behind and under the mask 14 (FIGS. 1 and 2). FIG. 3 is a front view of the optical guide 16 oriented essentially as it would be in its position fitted in the headlamp illustrated in FIG. 1, while FIG. 4 is a rear view.

The optical guide 16 is made of transparent or translucent material, is advantageously of unitary construction, and is produced by injection molding of plastic.

The optical guide 16 is generally extensive and essentially comprises a tubular and rounded guiding segment 18.1 and 18.2 and a web 20 adjacent and connected to the guiding segment 18.1 and 18.2. More particularly, the optical guide 16 comprises two guiding segments 18.1 and 18.2 arranged one in the extension of the other, along the rear edge of the web 20. Each of the guiding segments 18.1 and 18.2 is supplied, at one end, via an entrance face, by a specific light source. It will be understood that the number of guiding segments may vary and especially depend on the length of the web to be supplied with light and also on the space available to house the light sources. The light gradually exits the guide via a rib connecting the guiding segment to the web. The web is thus supplied with light along the entire length of its rear edge.

The one or more guiding segments are generally tubular with a transverse cross section that has a rounded profile, such as a circle or an oval, so as to be able to guide the light via successive reflections from the dioptric interface formed by the exterior surface making contact with the ambient air.

Figure 5:
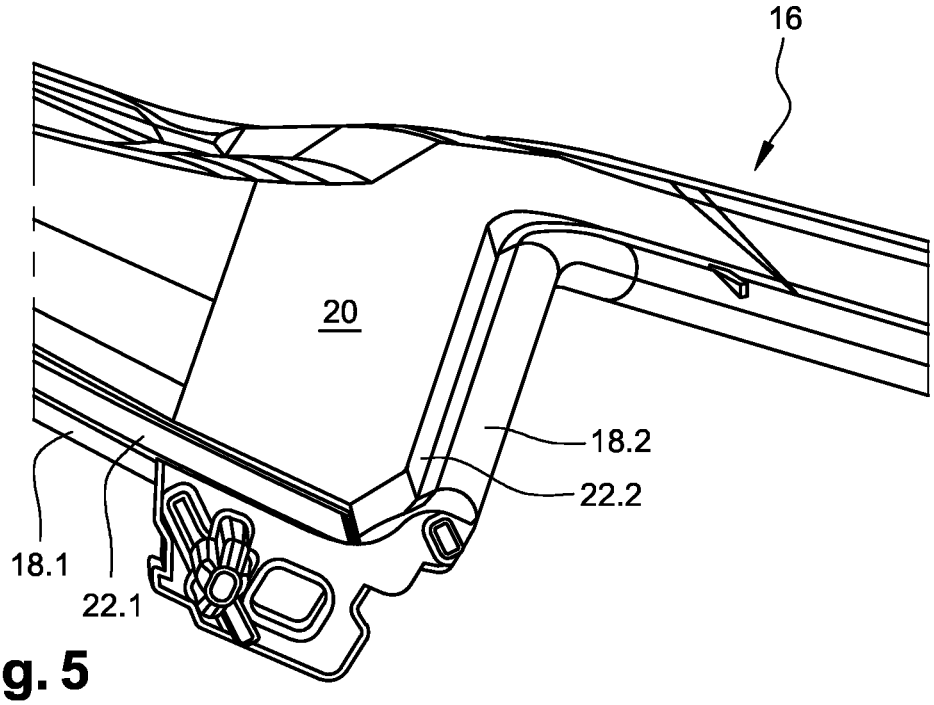
FIG. 5 is an enlarged representation of a central portion of the optical guide of FIG. 4.
Figure 6:
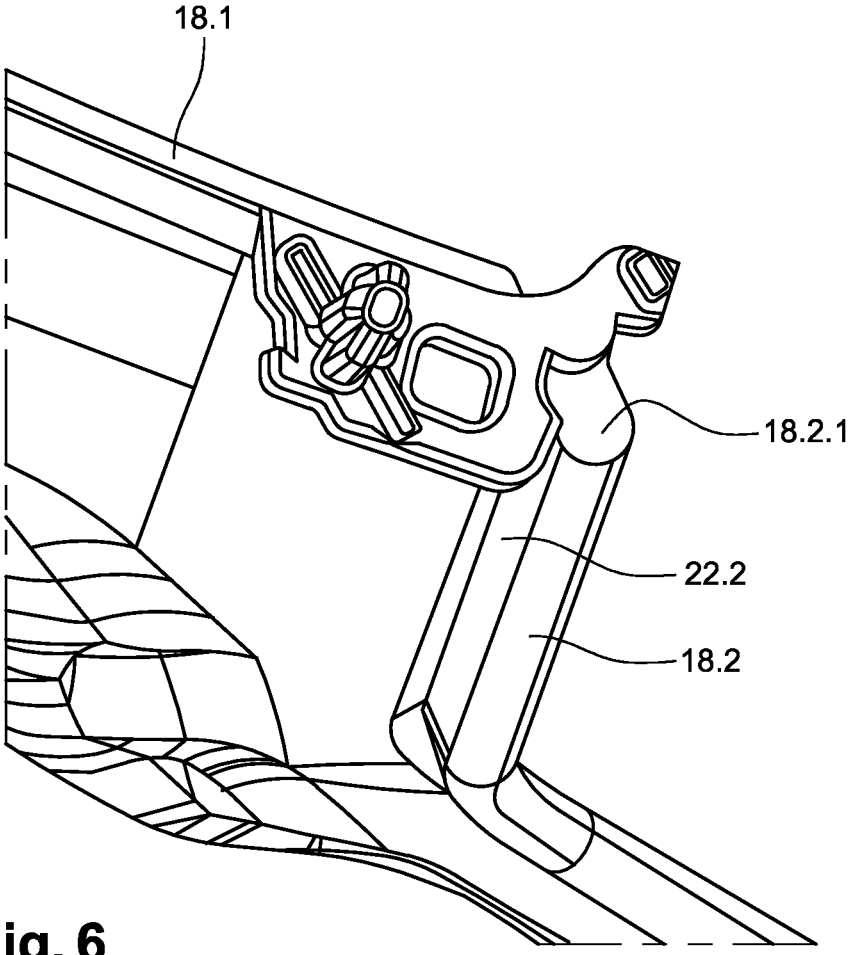
FIG. 6 is a representation from another angle of the central portion of the optical guide of FIG. 5.

FIGS. 5 and 6 are rear detail views of the central portion of the optical guide of FIGS. 3 and 4. The first guiding segment 18.1 and above all the start of the second guiding segment 18.2 may be seen therein. Each of the guiding segments 18.1 and 18.2 is connected to the web 20 by a rib 22.1 and 22.2, respectively. It may be seen that these ribs 22.1 and 22.2 form grooves in the upper and lower faces of the optical guide 16, essentially because of the thickness and the inclination of the ribs in question. Each of the guiding segments 18.1 and 18.2 has, at one of its ends, an entrance face for light. In FIG. 6, the entrance face 18.2.1 of the second guiding segment 18.2 may be seen. A Fastening means, such as positioning pins, have been shown near the entrance face 18.2.1 of the second guiding segment. Similar means are also provided at the other ends of the guiding segments 18.1 and 18.2, namely near the entrance face of the first guiding segment 18.1 (on the left in FIG. 4) and at the end of the second guiding segment 18.2 (on the right in FIG. 4).

Figure 7:
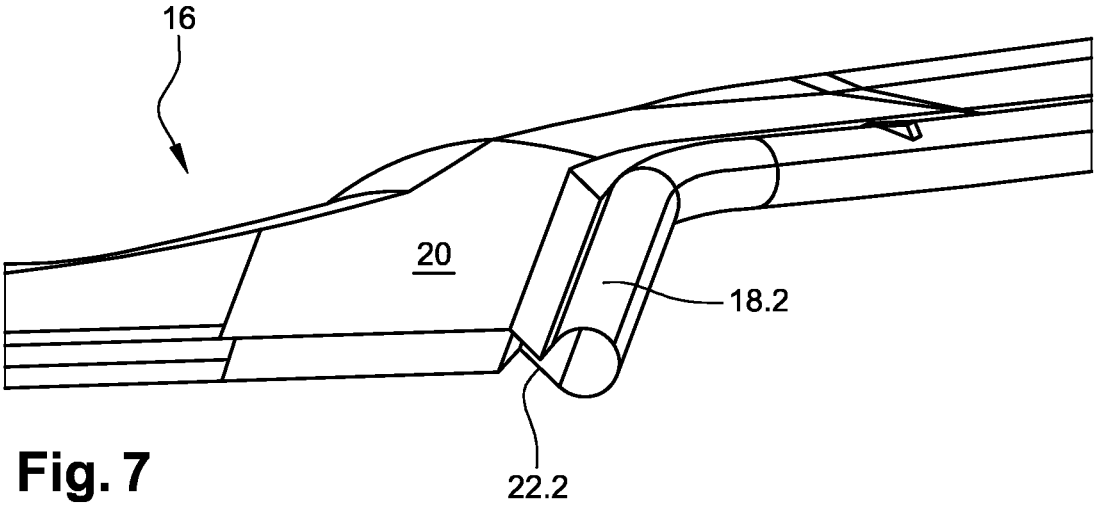
FIG. 7 is a cross-sectional view of the central part of the optical guide of FIG. 5.
Figure 8:
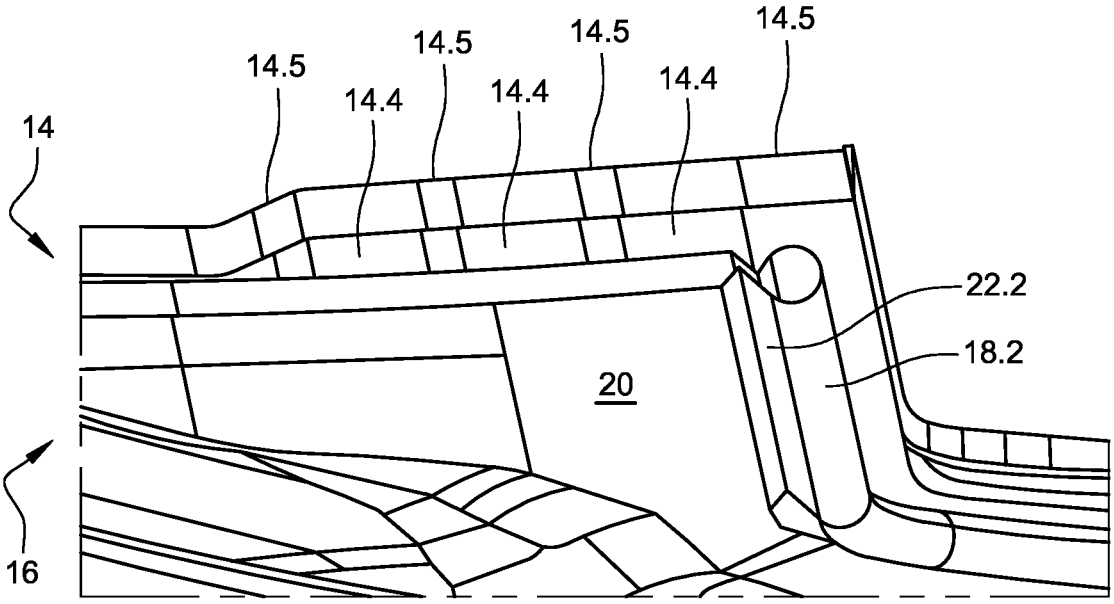
FIG. 8 is a view from another angle of the cross section of FIG. 7, with the mask of FIG. 2.

FIGS. 7 and 8 are two cross-sectional views of the central portion of the optical guide, which portion is illustrated in FIGS. 5 and 6.

In FIG. 7 the rib 22.2 connecting the web 20 to the guiding segment 18.2 and the grooves that said rib forms in the upper and lower faces of the optical guide 16 may be seen. The rib 22.2 has a shape that changes so as to gradually promote the exit of light from the guiding segment 18.2 to the web 20, as distance is increased from the light source, so as to compensate for the gradual loss of light. The cross-sectional view in FIG. 7 is close to the entrance face 18.2.1 shown in FIG. 6. The amount of light transmitted by the guiding segment 18.2 is therefore still large. For this reason, the rib 22.2 has a shape which is not very favorable to the transmission of light to the web 20, while further downstream along the main direction of the guiding segment 18.2, the shape of the rib 22.2 gradually changes so as to promote the transmission of light to the web, with a view to ensuring a uniform distribution of light all along the guiding segment.

It will be understood that the sense in which the shape of the rib changes, namely so as to decrease or increase the fraction of light travelling the guiding segment that is made to exit from said segment, along the guiding segment may be different, especially depending on the location of the one or more light sources and on the requirements in terms of light.

The thickness of the rib allows the amount of light transmitted to the web to be influenced in a fairly direct manner. To this end, the rib 22.2 has a thickness that is limited in proximity to the entrance face for light and that gradually increases downstream along the guiding segment 18.2. Other parameters of the shape of the rib are also capable of influencing the amount of light transmitted to the web, such as especially the inclination of the rib with respect to a direction passing through the center of the guiding segment and the junction region of the rib.

It will be understood that everything that has just been described with respect to the rib of the second guiding segment 18.2 also applies to the rib of the first guiding segment 18.1.

FIG. 8 illustrates the correspondence between the optical guide 16 and the mask 14, more particularly in the windows 14.4 forming the luminous strips. The opacifying coating 14.5 deposited on the exterior and upper face of the transparent or translucent material of the mask 14, forming the three windows 14.4, may be seen therein. The web 20 comprises a means of allowing the light travelling the web via successive reflections through its extent to exit through the upper face. This means may comprise a grain on the exit face and are detailed below with reference to FIG. 10.

Figure 9:
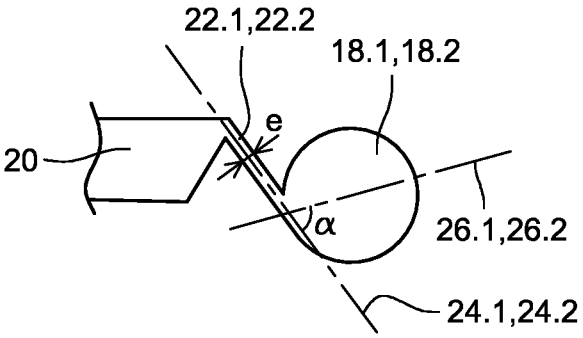
FIG. 9 is a cross-sectional detail view of the optical guide near the entrance face for light.
Figure 10:
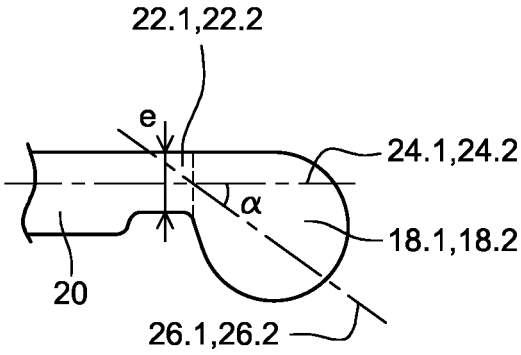
FIG. 10 corresponds to FIG. 9 at distance from the entrance face for light.

FIGS. 9 and 10 are cross-sectional detail views of the guiding segment and the rib connecting it to the web, FIG. 9 illustrating a rib shape that is less favorable to the transmission of light to the web and FIG. 10 illustrating a shape that is more favorable to the transmission of light to the web.

FIG. 9 essentially corresponds to the configuration of FIG. 7. The rib 22.1, 22.2 extends in a main direction 24.1, 24.2 with an average thickness (represented by variable "e"), and makes an angle α to a radial direction passing through the region of adjacency of the rib to the guiding segment 18.1, 18.2. A small thickness "e" decreases the fraction of light exiting the guiding segment, per unit length of said guide, and vice versa. Similarly, a small angle α increases the fraction of light exiting the guiding segment, per unit length of said guide, and vice versa. Specifically, the light rays propagating along the guiding segment 18.1 and 18.2 are liable to exit the guide and undergo a reflection in the rib at distance from said segment or in the web mainly when the rib is aligned with the ray passing through the region of adjacency of the rib to the guiding segment, or in other words when the angle α is zero. When this angle is large, some of the rays reflected from the region of the rib adjacent to the guiding segment will remain in said segment. The rest of the rays will be reflected multiple times in this region and then in the rest of the rib before reaching the web. This means that re-entry of these rays exiting in the web occurs more downstream. It is also clear that the thicker the rib, the higher the number of rays that exit from the guiding segment to the web.

The thickness "e" of the rib 22.1 and 22.2 may have a minimum value of 0.3 mm and exhibit a variation of more than 1 mm, and preferably more than 1.5 mm. Advantageously, the maximum value of the thickness "e" of the rib is lower than the average diameter of the guiding segment, and preferably lower than 70% of said diameter.

FIG. 10 illustrates a shape of the rib 22.1, 22.2 that is more favorable to the exit of light to the web, because of the larger thickness "e" and the smaller angle α, in comparison with the configuration of FIG. 9.

Figure 11:
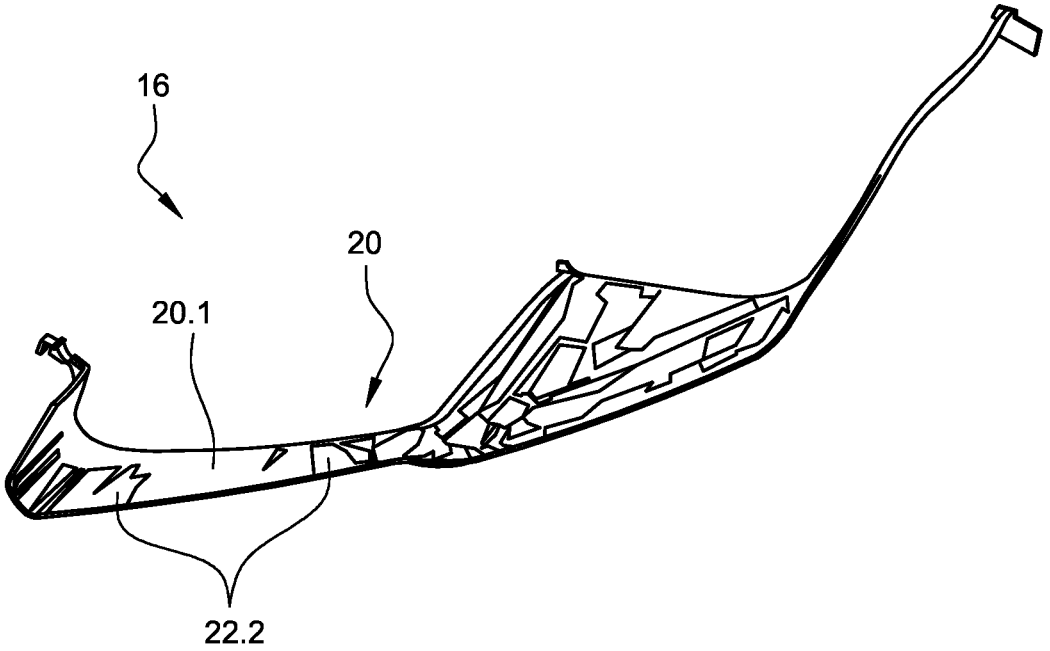
FIG. 11 is a perspective, face-on representation of the optical guide of FIGS. 3 to 10, showing a surface treatment, of the grain type, intended to make the light exit upward.

FIG. 11 is a representation of the optical guide 16, such as in FIG. 3. This however shows the means of allowing light to exit of the upper face of the web 20. This means consists of a grain 20.2 in certain regions of the upper face, whereas the rest of said face 20.1 remains smooth. The grain advantageously has a grain size larger than 20 μm and/or smaller than 40 μm. This grain is advantageously produced during the molding of the optical guide 16, by graining the regions in question of the mold. Such graining of the mold may be carried out by applying a laser beam.

Figure 12:
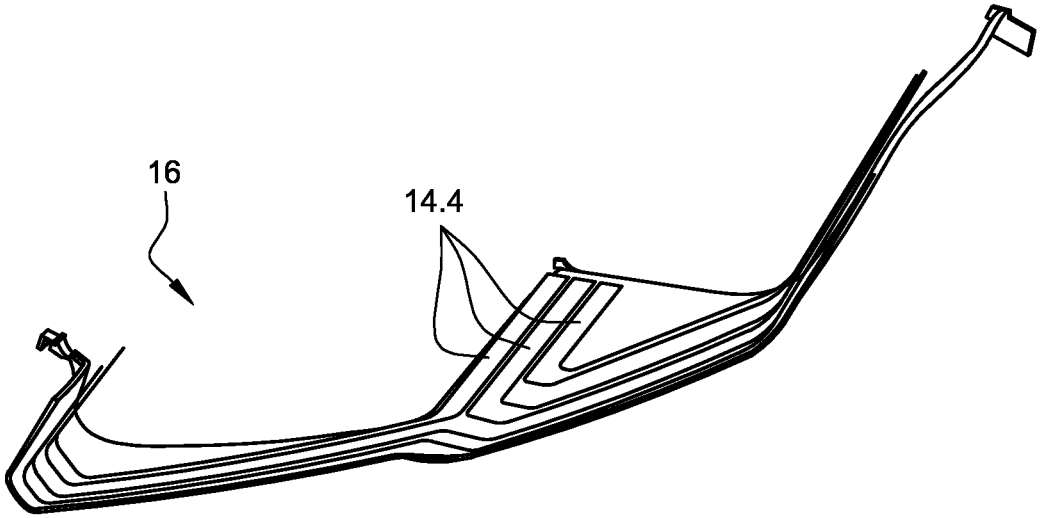
FIG. 12, which corresponds to FIG. 11, in addition illustrates the transmission windows of the mask of FIG. 2.

FIG. 12 corresponds to FIG. 11 with however the windows 14.4 of the mask shown, the latter not however being shown.

By comparing FIGS. 11 and 12, it may be seen that the grained regions are in a number of places wider than the corresponding windows 14.4, this making it possible to prevent lighting defects from being visible at certain angles of observation. In other words, this configuration makes it possible to avoid parallax defects.

The optical guide, the style signaling module and the headlamp that have just been described are advantageous in that they allow a signaling function of potentially complex shape to be provided while ensuring a light intensity of good uniformity, in particular as seen from various vantage points in front of the headlamp, cost-effectively.

What is claimed is:

1. An optical guide made of a material that is transparent or translucent, extending in a main direction comprising:

a tubular and rounded guiding segment that forms a tubular and rounded dioptric interface with an exterior environment, said guiding segment configured to guide light along the main direction via successive reflections from said dioptric interface;

a rib adjacent to said guiding segment that is adapted to make light exit from said guiding segment; and characterized in that the rib has a variable shape along the main direction so as to modulate an amount of light exiting along the main direction, the rib includes a thickness "e" or an inclination α with respect to a direction transverse to the main direction.

2. The optical guide of claim 1, characterized in that the variable shape of the rib passes through a center of said guiding segment.

3. The optical guide of claim 2, characterized in that the thickness "e" of said rib varies by a value higher than 50% of an average value of the thickness "e" over an entire extent of the rib or the inclination α of the rib varies by more than 20°.

4. The optical guide of claim 1, characterized in that the variable shape of the rib is configured to promote an exit of light as distance from an entrance face increases at one end of the entrance face for light, so as to compensate for a decrease in an amount of light travelling said guiding segment, and the thickness "e" of the rib increases with distance from the entrance face or the inclination α of the rib decreases with distance from the entrance face.

5. The optical guide of claim 1, characterized in that said guiding segment has an average diameter, the rib having a maximum thickness "e" smaller than 70% of said diameter, and the average diameter of said guiding segment is constant over more than 90% of a length of said guiding segment.

6. The optical guide of claim 1, characterized in that said guiding segment has an average diameter and said guide extends in the main direction over a length longer than 20 times said diameter.

7. The optical guide of claim 1, characterized in that the variable shape of the rib exhibits a number of variations over more than 80% of a length of the guide.

8. The optical guide of claim 7, characterized in that said guide further comprises a web adjacent to the rib that is optically connected to said guiding segment by said web, and said guiding segment is a first guiding segment and the rib is a first rib, the optical guide including a second guiding segment and a second rib adjacent to the web.

9. The optical guide of claim 8, characterized in that the web includes two main and opposite faces, where at least one of said faces includes a number of regions with a means for allowing light to exit through one of said faces that form a number of lighting regions, and the means for allowing light to exit on one of the main faces of the web includes a grain.

10. The optical guide of claim 9, characterized in that the grain has an average grain size larger than 20 μm or smaller than 40 μm.

11. A luminous module comprising:

at least one light source;

at least one optical guide adapted to be supplied with light by the at least one light source; characterized in that the at least one optical guide is made of transparent or translucent material, extending in a main direction comprising:

a tubular and rounded guiding segment that forms a tubular and rounded dioptric interface with an exterior environment, said guiding segment configured to guide light along the main direction via successive reflections from said dioptric interface; and a rib adjacent to said guiding segment adapted to make light exit from said segment characterized in that the rib has a variable shape along the main direction so as to modulate an amount of light exiting along the main direction.

12. The luminous module of claim 11, characterized in that the at least one optical guide in said module further includes a mask placed against a web, said mask comprising a number of windows aligned with a number of regions provided with a means for allowing light to exit, and the mask is made from transparent or translucent material and includes a paint delineating said windows.

13. The luminous module of claim 12, characterized in that said windows of the mask have a number of grained faces facing the web.

14. The luminous module of claim 11 further including at least one luminous signaling module.

15. The luminous module of claim 12, characterized in that the at least one optical guide, further includes one or more of said guiding segments that directionally extend predominantly transversely and the web extends from said guiding segments predominantly in a longitudinally forward direction, a number of lighting regions of the web being located on an upper main face of the web.

* * * * *